United States Patent [19]

Okazaki

[11] Patent Number: 4,929,415

[45] Date of Patent: May 29, 1990

[54] METHOD OF SINTERING POWDER

[76] Inventor: Kenji Okazaki, 62 Candlewood Dr., Nicholasville, Ky. 40356

[21] Appl. No.: 162,591

[22] Filed: Mar. 1, 1988

[51] Int. Cl.[5] ..... B22F 1/00

[52] U.S. Cl. ..... 419/52; 75/244; 75/246; 75/249; 419/10; 419/12; 264/125

[58] Field of Search ..... 419/52, 10, 12; 75/244, 75/249, 246; 264/125

[56] References Cited

U.S. PATENT DOCUMENTS

| | | | |
|---|---|---|---|
| 3,598,566 | 8/1971 | Inoue | 75/0.5 R |
| 3,738,828 | 6/1973 | Inoue | 75/0.5 R |
| 3,932,760 | 1/1976 | Inoue | 250/251 |
| 4,005,956 | 2/1977 | Inoue | 250/431 |
| 4,067,096 | 1/1078 | Whalen | 29/403 |
| 4,456,578 | 6/1984 | Ward | 419/52 |
| 4,549,981 | 10/1985 | Gupta et al. | 419/38 |
| 4,584,445 | 4/1986 | Kashiwagi et al. | 75/246 |
| 4,686,338 | 8/1987 | Kashiwagi et al. | 75/236 |

*Primary Examiner*—Stephen J. Lechert, Jr.

*Attorney, Agent, or Firm*—Oblon, Spivak, McClelland, Maier & Neustadt

[57] ABSTRACT

A method for sintering and forming powder is disclosed. In this method a high voltage of 3 KV or more is applied to a mold filled with powder using an electrode which maintains a high current of 50 KA $cm^{-2}$ or greater for a period of time from 10 to 500 microseconds. A device for practicing this method is also disclosed.

4 Claims, 3 Drawing Sheets

METHOD OF SINTERING POWDER

SUMMARY OF THE INVENTION

The present invention provides a method for sintering and forming powder which is characterized by applying a high voltage of 3 KV or more to a mold filled with powder using an electrode which maintains a high current of 50 KA/cm$^2$ or greater for a short period of time, 10 to 500 micro-seconds ($\mu$-sec).

The present invention also provides a quick-cooled powder hardening and solidification device compound of an electrical power source and capacitor, an electrical power source unit, which supplies a high voltage and current, a switch unit which allows a high voltage and current to flow for an instant, a measuring unit, which allows the numerical values for the amount of voltage, current, etc. supplied in the process to be monitored, and an electrode unit which passes electricity through the powder.

DETAILED DESCRIPTION OF THE PREFERRED EMBODIMENTS

Figure 1A:
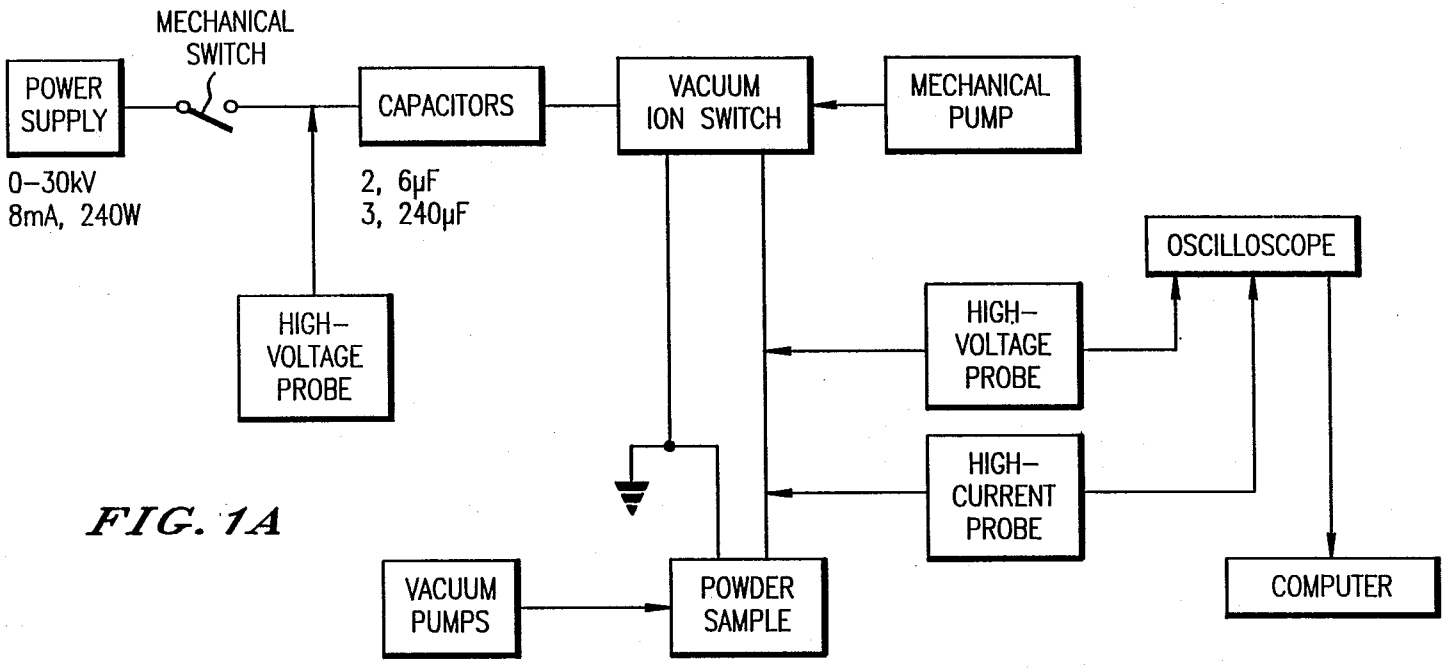
FIG. 1*a* is a schematic diagram of EDC and FIG. 1*b* illustrates an equivalent circuit of EDC.
Figure 1B:
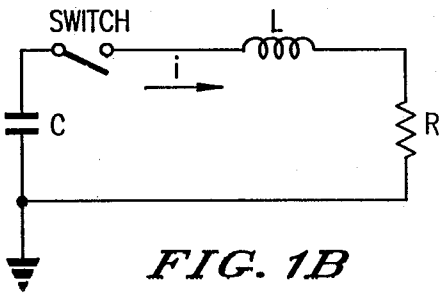

The rate of cooling which is implemented in water atomized, gas atomized, or melt spun materials, etc., allows one to obtain through said quick cooling processes (eg. $10^1$ to $10^8$ °C./sec), as compared with normal coding rates of $10^{-2}$ to 10° °C./sec, different cooled physical properties and infra-structures in a non-equilibrium phase. In addition, the cooling rate for differing formulations of alloy elements allows one to obtain amorphous phase cooled structures.

By utilizing a quick-cooling process, as shown on an equilibrium status chart, almost no solid solution among the components is obtained, the elements are each in large quantity solid solution within a matrix. By strengthening this solid solution system, it would be possible to improve the properties of the materials so there have been a large number of attempts to do so along this line. Also, there have also been attempts to strengthen the distribution of elements by using a heat treatment following the quick cooling, so that a uniform micro-structure could be obtained by supersaturation of the matrix solid solution components so that the distribution would be enhanced.

The above example would correspond to Al-Fe micro structure phases which have enhanced distribution in combinations such as Al-Fe-Ce, Al-Fe-Mo, Al-Fe-V, etc. according to the above methods.

Additionally, materials of Fe-B-Si and Fe-Ni-B, etc. have undergone the melt spinning or water atomization method in order to prepare amorphous materials to prepare electromagnetic materials, corrosion resistant materials, or wear-resistant materials.

By powdering the ingredients, it is possible to increase the amount of alloy elements added, and to assist in obtaining a uniform micro structure of the composition. The IN 100, Astroloy, etc., type super alloy powder or the various types of high alloy steel powders such as Ti alloy powder are such quick cooling process powders.

The present situation, however, is one in which the high hopes that have been placed upon the above quick-cooled powder raw materials for achieving strength improvements or improvements in the properties of the materials have not been well-reflected in the commercialization of such materials. One of the reasons for this is that when they are heated for processing, the composition resulting from the quick cooling process is lost.

Methods used for hardening and forming include the HIP method and the hot press rolling mill extrusion methods. With either of those methods, a high strength can be obtained when quick-cooled raw materials are used than when more traditional materials are used, and in addition, better heat resistance is also obtained in most cases, but to do this, high pre-heating temperatures are required in the process. This causes granulation of the dispersed phase or growth in grain size, so the properties inherent in the quick cooled raw materials are lost. Also, since in amorphous materials, the temperature of crystallization (Tg) is lower than the processing temperatures which must be used, it has come to be believed that hardening such amorphous materials is well-near impossible.

This invention, however, provides a method of hardening and forming quick-cooled materials while retaining their inherent properties.

This invention involves instantaneously passing a high voltage and current through such powder materials so that a physical-chemical phenomenon takes place at the contact points among the powder particles accompanying this electrical discharge so that the powder particles are metallurgically bonded. While an improved density can be realized by applying an electromagnetic field to the powder at the time of the electrical discharge, without applying pressure to the powder, when one desires a density exceeding 90%, one should also apply pressure to the powder at this time.

It is believed that the physical-chemical phenomenon at the contact points among the powder particles occurs in the following 4 stages.

(i) By applying a high current, oxides, which are insulating substances, become semi-conducting or conducting, and when heated, heat accumulates between them and the matrix (which is most cases is a good conducting metal);

(ii) The heating causes the particles partially melt or become vaporized so that the oxide substances are eliminated;

(iii) Necks are formed;

(iv) The necks grow.

The above 4-stage process occurs instantaneously, on the order of micro seconds.

Despite the fact that this view of the process holds that the passing through of electricity causes localized melting or vaporization, the reason why the properties resulting from the quick-cooling in the materials being processed are retained is that the melting or vaporization takes place on only a small part of the particles, on the surface area, so that the other parts of the materials act as heat sinks so that quick hardening of the melted or vaporized areas occurs. Thus, the process implemented by this invention means that not only is the structure of the quick cooled powders retained, but after the process, ultra-quick cooled structural changes in the structure can be observed. For example, with Al-Fe alloy, it is generally believed that hardening rates on the order of $10^6$ cannot be achieved. However, amorphous phase can be confirmed in Al-Fe alloy after it has been so processed.

Thus, in conditions where this instantaneous high voltage, high current electrical discharge is applied to harden and form quick-cooled materials, not only are the properties inherent from this quick cooling retained, they are enhanced.

The voltage used should be within a range of 3 to 30 KV, according to experimental results obtained. If less than 3 KV is used, one cannot expect that the powder will be sufficiently hardened, and if more than 30 KV is used, more than the permissible amount of melting will take place and the properties of the quick-cooled structure will be lost.

The amount of time in which this electricity is applied has been experimentally determined to be 10 to 500 microseconds. If it is applied for fewer than 10 micro seconds, one cannot expect that the powder will be sufficiently hardened, and if it is applied for more than 500 micro seconds, too much Joule heat will be generated and the quick-cooled structure will be lost.

The environment used while the electricity is passed through may be the atmosphere, a protective gas, or a vacuum. However, in this invention, for example, when implemented under reduced pressure, in the range where a glow discharge is produced, since the discharge is taking place in a plasma type gas, it is difficult to obtain a metallurgical bonding from the physical phenomena which take place at the contact point among the powder particles. Therefore, processing within the glow discharge range should be avoided.

When the discharge takes place under atmospheric conditions, there is no need for concern about oxidation since the heating is only localized. Since even a protective oxide membrane around the powder particles is lost through the instantaneous processing of this invention, in the areas where the particles are bounded together, the oxide covering is removed and there are no PPB (prior particle boundaries).

Even when the powder is placed inside of a glass pipe and no pressure is applied when implementing this invention, one can anticipate densities in the 60 to 70% range. When a density exceeding 90% is desired, it is necessary to pressurize the powder inside of the mold. The amount of such pressure applied differs according to the formulation of the powder, but good results for the final density will be achieved using pressures which result in a density of up to 60% prior to the process implementation. If too much pressure is applied, the particles will melt together and the resistance values of the resulting substance will decline. This is because the specific resistance will come too close to that of the circuit used to supply the electricity, preventing effective application of the current.

The specific resistance of the discharge circuit used in these experiments was about 3 mΩ (milli-ohms) and under these conditions, it was found that high densities could be achieved when the resistance value for the powder ranged between 30 and 100 milli-ohms.

Electrical discharge sintering methods are known to the art where when forming the powder, the powder is placed inside of a conducting graphite mold and the graphite mold and pressurizing punch act as electrodes through which an electrical discharge is passed, and the resulting Joule heat sinters and solidifies the powder.

With these electrical discharge sintering methods of the prior art, however, such as the one in Patent Kokai Publication Sho 57-578027 (1982), the electricity is passed through the powder from 1 to 20 seconds, or in some cases, for as long as several minutes. It is not an instantaneous discharge sintering principle as proposed in this invention; the two methods are basically different.

With the discharge sintering methods of the prior art, the Joule heat generated was the principal means of accomplishing the sintering; the discharge caused the temperature of the powder to be raised to the sintering temperature—it is clear that the overall temperature of the particles was raised.

With this invention, on the other hand, the high temperature heating is confined to localized areas of each particle, and the heat is immediately dispersed so that immediately after this discharge processing, it is possible to touch the sintered object with the hand—the temperature is under 40° C.

Inasmuch as a localized melting is utilized in this method, it is similar to the methods that employ bombardment with high speed projectiles or those which use an explosion generated shock wave to solidify the powder. When the energy input quantity is controlled in these methods, localized melting on the surfaces of the powder particles is instantaneously achieved, but directly afterward, this heat is absorbed by the surrounding material so that there is a quick hardening of the melted areas so that quick-cooling structures not inherent even in the original powder materials have been reported.

However, with these other methods, it is very difficult to control the amount of energy applied. Also, since energy absorption differs according to the form in which the powder is shaped, at the present time, it is deemed too difficult to bring these methods to practical application for making heavy sintered objects having a uniform consistency.

A number of researchers have also reported their attempts to apply a direct electrical discharge to a powder in order to sinter it.

For example, Akechi and Hara(1) reported using low voltage power sources of 2 to 5 volts to apply a discharge over a 0.5 to 3 second time span at a pressure of 1000 kg/cm$^2$ in sintering Ti powder to a density of 96%.

(1) Titanium Vol. 80, P. 2265, 1982

Saito(2) reported using a 60 μF capacitor to apply a 15 KV voltage at a pressure of 600 kg/cm$^2$ to al powder to eliminate the oxide membrane to improve density by 12%.

(2) Technical Report of Tokyo Industrial Univ., Vol. 120, P. 137, 1974

Al-Hassan(3) reported experimental conditions which were close to the values used in this invention. Iron powder was tap-filled into a pyrex glass tube and a vacuum was applied to remove the air, an electrode was set at both ends and a voltage of 20 KV was applied for 100 micro seconds to obtain a porous bar having a density of 60%.

(3) Int'l. J. Mech. Sci., Vol. 18, No. 1, P. 37, 1976

In this invention, discharge processing was used to form Ti powder where without pressure being applied, densities of 80% were achieved, and with less than 1/10 the pressure used by Akechi and Hara, 75 kg/cm$^2$, densities of 95% were achieved. This means that the mechanism for the solidification and forming was essentially different for both.

While the paper by Saito, et al., makes no reference to the importance of discharge time and the atmosphere under which the discharge takes place, the discharge processing used in this invention takes place under loads 1/10 as great as those of Saito and yields 20% or move improved density, so it can be concluded that Saito, et al., were unaware of the importance of the discharge time and the discharge environment.

In the case of Al-Hassan, it is clearly stated in the paper that the forming of the powder made use of a glow discharge, so the solidification structure was different from that of this invention. In experiments related to this invention, the interior of the mold was held in a vacuum and pressure was applied, but when in the range where a glow discharge resulted, the solidification took place, but it was insufficient, so it was confirmed that this method of solidification and forming of the powder was insufficient.

What is meant here by quick cooled powder materials are those materials which are hardened at a rate of 10° C./sec or greater produced by the water atomization, gas atomization, rotating electrode method, rotating cup method, centrifugal atomizing method, pendant drop method, melt drag method, melt extraction method, melt spinning method or other method where a molten liquid is made into a powder or a thin ribbon, flakes, or pins. Normally, the ribbon type materials are crushed into a size of 1 mm or less before use. It is possible, of course, to use powders in the method of this invention which are not of the quick cooled type.

The materials for which this invention may be used include various combinations of elements or their alloys, but they must be conductors of electricity. In addition, conducting types of plastics or ceramics may also be processed using the method of this invention.

There are no theoretical limitations upon the size or the shape of solid forms which may be made from the powder. Since the solidification of the powder takes place through localized heating, it is necessary to increase the amount of input electrical energy to up the amount of energy corresponding to increasing diameters of the formed object, but this does not involve any basic changes in the behavior of the resulting solid form. When parts having a complex shape are to be solidified, there must be sufficient consideration given to the design of the electrode so that the electricity passes uniformly within the powder, but this involves no changes in principle.

Various pressurization methods may be implemented as forming methods, but since the effective time when electricity is passed through is exceedingly short, it is difficult to invoke a dynamic pressure in sync with the time when the current is flowing. It is therefore best if a static, mono-axial or poly-axial pressure is applied and then the current applied. The current can be applied once or a number of times, but since once the discharge has taken place, the resistance values are dramatically reduced, it is not effective to repeat the process in the same place.

With this method, in making large, solid, formed products, the method can be incorporated with a static hydraulic press, or pellets of rolled stock or ultra-alloy or high speed steel powder may be used. It can be used with a press to produce cone or rod bearings, etc.

There is also no need for the formed product to be of a single composition. Different types of powder materials such as dispersion strengthening materials, may be added as needed or a different type of powder formulation may be used in certain areas to form dual phase parts. One of the dual phase components may be put in place by molten casting. The instantaneous application of electricity used in the method of this invention allows no time for the formation of harmful phases at the boundaries between different types of materials, so it can be said to be more appropriate for making dual phase products, compound materials, or bonded materials than processes which require a longer heating time.

The configuration diagram shows the device for solidification and forming of quick-cooled powder and a circuit diagram for it. The main point in the device to implement this invention is the employment of a capacitor and a vacuum ion switch so that the high voltage current can be input momentarily. The vacuum ion switch is connected with an electrode which is sealed within a glass tube which is placed under a vacuum and it is configured so that it allows electricity to pass due to the plasma ions in the glow discharge range. This makes a momentary flow of voltage and current possible. When it is possible to implement process conditions of 8 KV or under, then it is also possible to control the passage of electricity time and the cycle relatively easily using a thyrotron or an ignitron at the site of the vacuum ion switch.

EXAMPLES (1) 2 gr of powder crushed to −60 mesh which was made from Al-Fe-V alloy ribbon prepared by the melt spinning method were tap-packed into a 6 mm diameter pyrex tube. Electrodes were placed at either end and the process was carried out under atmospheric conditions. Various processing voltages were tried: 20, 25, 28, and 30 KV. While the density at thetime of powder filling was 45%, the resulting solids had densities of 60% or greater. For those powders processed at 20 and 25 KV, the micro structure following the implementation of this process was consistent with a quick-cooled structure which had properties over and above that of the original powder.

In other words, when the powders used for the experiment consisted of a B formulation which was corroded by chemical etching, and an A formulation which was a quick-cooled formulation that was corroded, when the process was implemented at 20 and 25 KV, the microscopic structure of the A formulation in the neck area was partially seen in the neck area in the B formulation too, and when the process was implemented at 30 KV, this effect was widespread. This experiment used a 100 μsec time for current input.

Figure 2A:
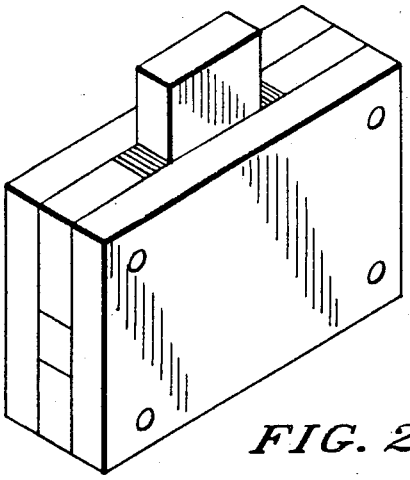
FIG. 2*a* is a schematic diagram of a ceramic die setting for electro-discharge compaction.
Figure 2B:
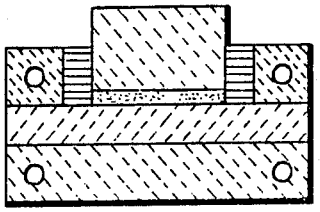
FIG. 2*b* is a longitudinal cross section of a ceramic die setting for electro-discharge compaction.
Figure 2C:
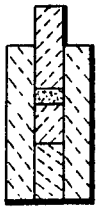
FIG. 2*c* is a transverse cross section of a ceramic die setting for electro-discharge composition.

(2) As shown in FIG. 2, 2 gr of this same Al-Fe-V powder were placed inside of a rectangular 5 mm×50 mm ceramic mold to a thickness of 2.5 mm and a pressure of 5.6 to 7.8 MPa was applied. In this case, experimental voltages of 2, 2.9, 3.7, 4.3 and 5 KV were used to prepare test samples, which were subsequently structurally examined.

The results indicate that the powder subjected to the 2 KV discharge showed but spotty neck formation, but with voltages of 2.9 KV and greater, density of the samples began increasing until a 95% density was reached at 5 KV. Electrical resistance values were measured for the samples to see if the bonding was sufficient metallurgically. While resistance was 70 to 122 mΩ prior to processing, it was 2 to 8 mΩ following the processing indicating that metallic bonds had been formed.

Figure 3:
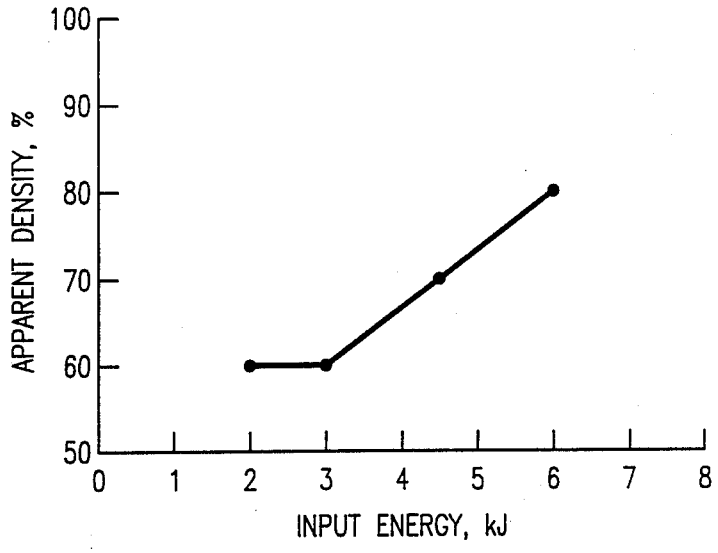
FIG. 3 is an apparent density of power compact versus input energy graph.
Figure 4:
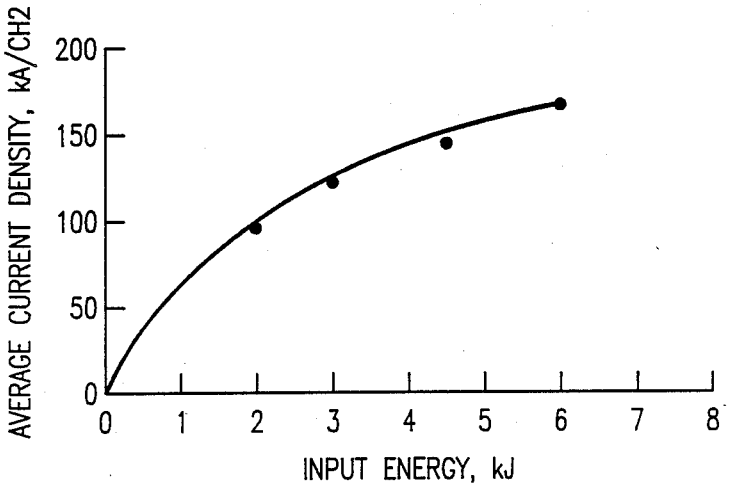
FIG. 4 is an average current density versus input energy for electro-discharge compaction of powders under pressure graph.

Also, using the same powder and device, the relationship between the current density and the density of the solidified product was investigated and those results are indicated in FIGS. 3 and 4.

As may be seen from FIG. 3, in order to achieve a density of 60% or greater, energy of 1 KJ or more was required. Also, as shown in FIG. 4, in order to obtain energies of 1 KJ or more, currents of 50 $KA/cm^2$ or more were required.

(3) With the objective of clarifying the mechanism through which oxide membranes were eliminated, Ni powder (100 to 150μ diameter) was heated in an air atmosphere until a 0.3μ thick oxide membrane had formed on the powder particles. This powder was used to fill pyrex glass tubes which were subjected to electrical discharges from 3 to 6 KV while exposed to the atmosphere to obtain a solid with a 60% density. Prior to the experiments, the electrical resistance value for the Ni powder having the oxide membrane was 30 mω, but after the electrical discharge process was implemented, it decreased to 4 to 10 mΩ. Incidently, Ni powder having an electrical resistance of 100Ω was purchased and subjected to this process. Not only was the thick oxide membrane removed by the electrical discharge process, but the surface of the product had a very pure metal appearance.

(4) Amorphous $Fe_{78}B_{13}Si_9$ ribbon prepared by melt spinning was crushed to a powder and placed in pyrex glass tube. After applying a 10 KV discharge to the powder there were no changes in the powder's composition, but it was confirmed that the amorphous structure of the material prior to the processing was unchanged following the processing.

What is claimed as new and desired to be secured by Letters Patent of the United States is:

1. A method for sintering powder, comprising applying a voltage of 3 KV or more to a mold filled with powder using an electrode which maintains a current of 50 KA $cm^{-2}$ of greater for a period of time of 10 to 500 microseconds.

2. The method of claim 1, comprising using a voltage of from 3 to 30 KV.

3. The method of claim 1, comprising using, as said powder, an Al-Fe powder, an Al-Fe-Ce powder, an Al-Fe-Mo powder, an Al-Fe-V powder, an Fe-B-Si powder, or an Fe-Ni-B powder.

4. The method of claim 1, comprising using, as said powder, an Al-Fe-V powder, or an Al-Fe powder.

* * * * *